United States Patent [19]

Hillenbrandt et al.

[11] 4,134,223

[45] Jan. 16, 1979

[54] ELECTRICAL TRIGGER MECHANISM FOR FIREARMS

[75] Inventors: Siegfried Hillenbrandt, Albstadt; Dieter Keppeler, Langenau, both of Fed. Rep. of Germany

[73] Assignee: Carl Walther GmbH, Ulm, Danube, Fed. Rep. of Germany

[21] Appl. No.: 856,683

[22] Filed: Dec. 1, 1977

[30] Foreign Application Priority Data

Dec. 16, 1976 [DE] Fed. Rep. of Germany ..... 2656996

[51] Int. Cl.[2] ..... F41C 19/12

[52] U.S. Cl. ..... 42/84

[58] Field of Search ..... 42/84, 26, 28, 34; 89/28 A, 135

[56] References Cited

U.S. PATENT DOCUMENTS

| | | | |
|---|---|---|---|
| 1,540,494 | 6/1925 | Olszowiec | 42/84 |
| 3,250,034 | 5/1966 | Simmons | 42/84 |
| 3,580,113 | 5/1971 | Ramsay et al. | 42/84 |
| 3,613,282 | 10/1971 | Ramsay | 42/84 |
| 4,009,536 | 3/1977 | Wolff | 42/84 |

*Primary Examiner*—Charles T. Jordan

*Attorney, Agent, or Firm*—Edmund M. Jaskiewicz

[57] ABSTRACT

A hand firearm has a breech block pivotally mounted in the frame so as to be pivotable downwardly from a closed position to a loading position. The breech block has a firing pin mounted therein which is actuated by an armature of an electro-magnet also disposed in the breech block. A source of electrical energy in the form of a removable unit is disposed in the frame and connected electrically to the coil. This electrical connection to the coil is disconnected when the breech block is pivoted downwardly into its loading position so that the electro-magnet can not be energized and thus actuation of the firing pin is prevented.

6 Claims, 1 Drawing Figure

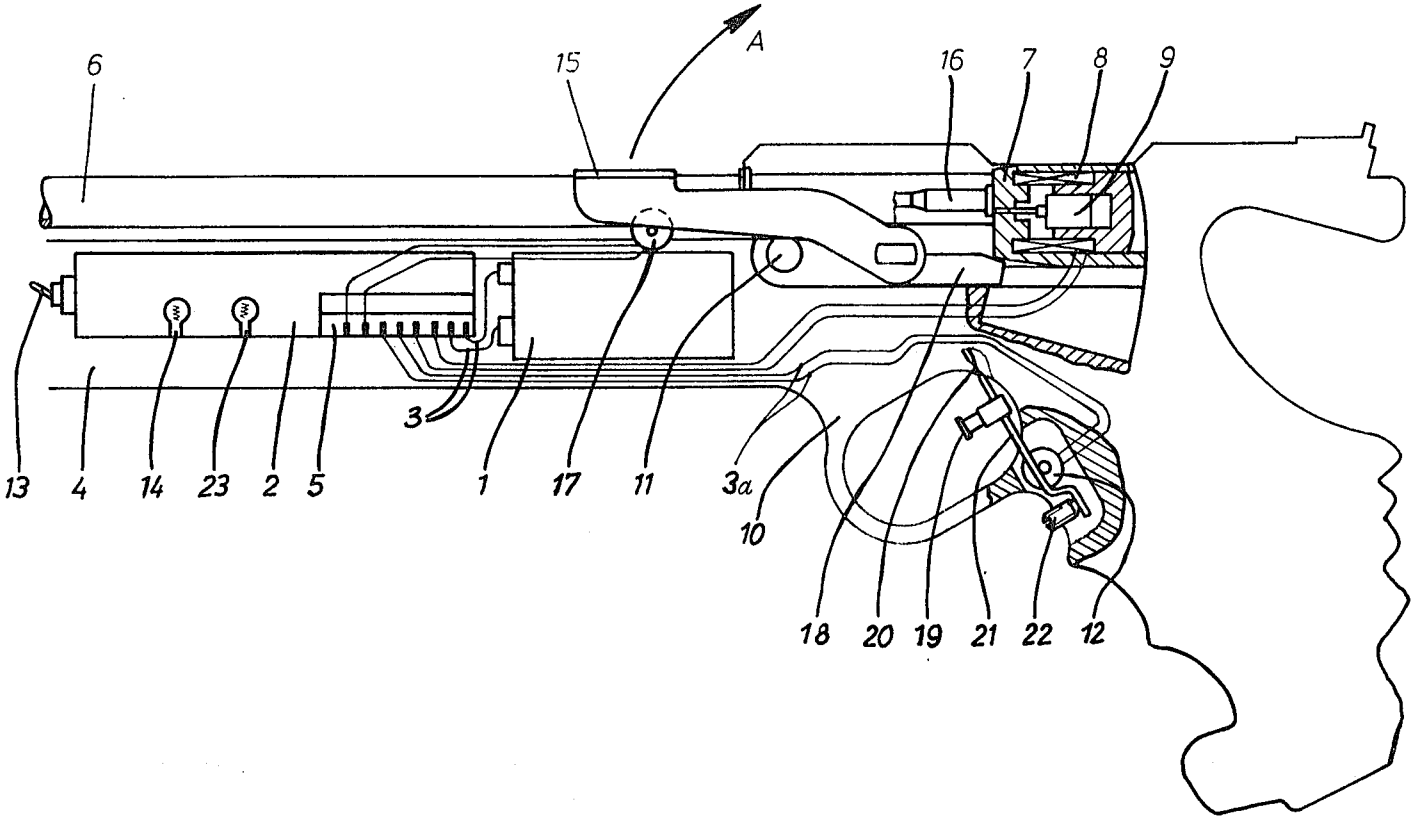
9
8
7
16
A
15
6
13
4
14
23
2
5
3
1
17
11
3a
10
18
20
19
21
22
12

ELECTRICAL TRIGGER MECHANISM FOR FIREARMS

The present invention relates to an electrically controlled trigger mechanism for hand firearms, more particularly, to the actuation of the firing pin by energization of an electro-magnet and for preventing actuation of the firing pin when the breech block is not closed.

Various forms of electronically controlled trigger mechanisms for hand firearms have been proposed wherein actuation of a trigger or release button causes a voltage to be applied to an electrical circuit which in turn energizes an electro-magnet to cause actuation of a firing pin. The German patent DT-PS No. 1 132 826 and the French patent FR-PS No. 1 446 514 and the French patent No. 84450 further show that a contact or contact switch closed by the user of the firearm will in turn close an electric circuit which will energize an electro-magnet to bring about a firing of the firearm. The user of the firearm applies pressure to a trigger element which in turn either opens or closes a pair of electrical contacts which in turn closes the electrical circuit for energizing the electro-magnet.

In the German patent DT-PS No. 1 553 868 there is shown an electrical contact which is opened on operation of the trigger to open a control circuit which switches a transistor into the conductive state whereupon the transistor applies voltage to a circuit that causes a movement of the firing pin to cause a firing of the firearm. Further, in the German published application DT-OS No. 2 404 053 there is disclosed a firing pin which is moved into the firing position by movement of an armature in an electro-magnet energized upon operation of the trigger. The coil of the electro-magnet is in a current discharge circuit together with a storage transistor and a thyristor which is fired upon operating of a contact switch actuated by the trigger. The coil of the electromagnet has a low ohmic resistance and can thus be charged to a high voltage. A battery operated voltage transformer circuit is provided for charging the storage capacitor.

The above-described prior art trigger mechanisms are generally not satisfactory under actual operating conditions since certain disadvantages result from the use of the switches or contacts which are opened or closed during movement of the trigger to initiate the firing of the firearm. These trigger mechanisms necessarily require one or more operations to close or open switches. In one sense, the presence of these switches is advantageous in that it enables the user of the firearm to feel or sense the actuation of the switches or contacts when the trigger is finely adjusted. However, such switch or contact systems have the significant disadvantage in that under actual operating condition the contacts may become dirty or soiled or may even freeze together so that firing of the firearm becomes unreliable. In actual use, such trigger mechanisms may cause an accidental or unintended firing in any position of the breech mechanism and may even bring about a complete failure of the firearm under competitive conditions when high standards of performance are required from the competing marksman.

It is therefore the principal object of the present invention to provide a novel and improved electrical firing mechanism for firearms.

It is another object of the present invention to provide such a firing mechanism which is simple in construction and function, and is reliable in operation.

It is a further object of the present invention to provide such a firing mechanism which can not be fired inadvertently particularly when the firearm is unlocked.

According to one aspect of the present invention a trigger or firing mechanism for firearms, particularly hand firearms, may comprise a breech block pivotally mounted in a frame and pivotable downwardly from a closed position to a loading position. A movable firing pin in the breech block is drivingly connected to a movable armature of a coil in an electromagnet so that energization of the coil moves the firing pin. A source of electrical energy is disposed in the frame and is electrically connected to the coil. Means are provided for disconnecting the source of electrical energy to the coil when the breech block is pivoted into its loading position so that energization of the electromagnet and thus actuation of the firing pin is prevented.

Other objects and advantages of the present invention will be apparent upon reference to the accompanying description when taken in conjunction with the drawing, which is a longitudinal sectional view of a portion of a firearm incorporating the mechanism of the present invention with the components being shown in their normal or initial positions.

In the drawing the firearm illustrated is provided with a known source of electrical energy including a dry battery 1 which is electrically connected by suitable wires 3 to a closed electronic unit 2 which may comprise the electronic circuit disclosed in U.S. Pat. No. 4,009,536 issued Mar. 1, 1977. The unit 2 is removably mounted in a stock 4 of the firearm so as to be replaceable. The electronic unit has a strip 5 of plug contacts and the several electronic components of the firing system are connected to the contact strip in such a manner so as to be readily connected or disconnected. The entire electronic unit 2 of a firearm can be readily removed so as to facilitate replacing of any defective components therein.

Mounted on the stock 4 is a barrel 6 the rear end of which is provided with a cartridge chamber 16. At the end of the barrel 6 which is rigidly attached to the stock 4 is a breech block 7 which is pivotally mounted on the stock by means of a pin 11 so as to be pivotable downwardly into a recess or chamber. The breech block is illustrated in the drawing in its closed position and when pivoted downwardly by applying a force to a handle 15 in the direction of the arrow A, the breech block opens the cartridge chamber 16 to permit loading or unloading of a cartridge.

Mounted in the breech block 7 is an electromagnetic coil 8 having a substantially cylindrical form and within the coil is an axially movable armature 9 which may be directly or drivingly connected to a firing pin projecting forwardly from the breech block 7 as shown in the drawing. The breech block, the elctromagnet and the firing pin is thus constructed as a complete and closed unit.

In a conventional manner, the firearm is provided with a handle at the end of the stock 4 and the handle has a trigger guard 10 thereon. Mounted in the handle is a light-sensitive device 12 in the form of a closed unit which comprises a light-sensitive cell upon which a beam of light impinges in a known manner. The light-sensitive device 12 can thus be readily removed and replaced as may be desired. A trigger in the form of a leaf spring 20 has its upper end fixedly attached to the handle and its lower end is freely movable and is engageable by an end of a set screw positioned in the handle 10 for the purposes of adjusting the movement required of the trigger 21 to interrupt the beam of light of the light-sensitive device 12. The trigger is provided with a release button 19 which is engaged by a finger of the user of the firearm. The light-sensitive device 12 is connected by leads 3*a* to plugs on the connector strip 5 of the electronic unit 2. The elctronic unit is further provided with a manually operable switch 13 which is accessible to the user from the outside of the stock and when closed will close an energy circuit which brings about charging of a storage capacitor connected in the electronic device 2 in a known manner. Charging of the capacitor to the required current value is indicated optically by a glow lamp 14 electrically connected to the unit 2 and mounted in the stock 4 so as to be visible from the exterior thereof.

In order to operate the firearm, the switch 13 is actuated to close the current circuit to begin charging of the storage capacitor. When the capacitor has been fully charged, the glow lamp 14 will be illuminated and will indicate that the firearm is ready for firing. The bolt handle 15 is then manually pivoted upwardly in the direction of the arrow A and the breech block 7 is unlocked in a known manner and pivoted downwardly. The breech on the end of barrel 6 is now exposed for loading and the cartridge may be inserted into the cartridge chamber 16. The bolt handle 15 is then pivoted back into its initial position as shown in the drawing to cause the breech block to be positioned in the breech closing position at the end of the barrel. In the final phase of the return of the bolt lever 15 to its final position the breech block is locked in its closed position. This mechanical loading procedure can be carried out simultaneously during the charging period of the storage capacitor in the elctronic unit 2.

In order to reliably prevent an accidental or unintentional firing of the firearm before the breech block is fully locked, a circuit breaker 17 is further provided in the stock 4 at the end point of the return displacement of the bolt handle 15 to its initial position. The circuit breaker 17 may comprise a contactless circuit which will interrupt the supply of electrical energy to the magnetic coil 8 to prevent actuation of the armature 9 while at the same time the charging of the storage capacitor is not hindered in any way. Further, no delay is introduced into the firing sequence. The circuit breaker 17 is preferably arranged on the stock 4 rather than on the bolt handle 15 and could also be positioned on a locking pin 18.

When the bolt handle 15 is locked in its initial position as shown in the drawing, the supply of current is now automatically reestablished. However, since there exists the possibility of the current supply remaining interrupted even after locking of the bolt handle, an additional switch may be provided on the firearm to close the power circuit.

When a slight finger pressure is applied to the trigger release button 19, the trigger 21 will be pivoted into the path of the light beam of the light-sensitive device 12. Interrupting of the light beam will send a pulse signal to the electronic unit 2 for the purpose of firing a shot. The set screw 22 enables the trigger 21 to be so positioned and adjusted so that the distance which must be moved by the trigger in order to interrupt the light beam may be made very short so as to provide a fine adjustment of the trigger and for almost instantaneous discharge of the firearm upon applying pressure to the trigger.

A second glow lamp 23 also visible on the exterior of the firearm is mounted on the electronic unit 2 for the purpose of such fine adjustment. The indicator lamp 23 will be energized during pulse signaling. In order to provide ready optical differentiation between the two indicator lamps 14 and 23, these lights may be of different colors such as red and green respectively.

It is to be borne in mind that the light-sensitive device may be replaced by contacts or plates which may interrupt an electrical field upon squeezing of the trigger.

Thus it is apparent that the present invention has disclosed an electronic firing mechanism which is simple in construction and reliable in operation. Further, the firing mechanism provides a dependable safeguard which prevents discharge of the firearm when the breech is not closed.

It will be understood that this invention is susceptible to modification in order to adapt it to different usages and conditions, and accordingly, it is desired to comprehend such modifications within this invention as may fall within the scope of the appended claims.

What is claimed is:

1. In a trigger mechanism for firearms, the combination of a frame, a breech block pivotally mounted in said frame and pivotable downwardly from a closed position to a loading position, a movable firing pin in said breech block, an electromagnet in said breech block having a coil and a movable armature actuated by said coil, said armature drivingly connected to said firing pin to move the same when said coil is energized, means for defining a source of electrical energy in said frame and connected electrically to said coil, and means for disconnecting said electrical connection when said breech block is pivoted into its loading position so that energization of said electro-magnet and thus actuation of the firing pin is prevented.

2. In a trigger mechanism as claimed in claim 1 wherein said frame has a handle, a trigger comprising a leaf spring mounted on said handle, and means in said handle defining a light-sensitive device having a light beam in the path of movement of said trigger so that interrupting of the light beam when said trigger is actuated sends a pulse to said electrical energy source means to energize the electro-magnet and actuate the firing pin.

3. In a trigger mechanism as claimed in claim 1 wherein there is a barrel mounted on said frame, said electrical energy source means comprising a removable unit disposed below said barrel.

4. In a trigger mechanism as claimed in claim 3 wherein said electrical energy source means comprises a plug-contact strip.

5. A trigger mechanism as claimed in claim 2 wherein said trigger leaf spring has one end attached to said handle and another end freely movable, and means engageable with said trigger element other end for adjusting the movement of said trigger required to interrupt said light beam.

6. In a trigger mechanism as claimed in claim 5 and light means on said frame connected to said electrical energy source means for indicating visually a pulse generated by said trigger.

* * * * *